US006877274B2

(12) United States Patent
Fiveash

(10) Patent No.: US 6,877,274 B2
(45) Date of Patent: Apr. 12, 2005

(54) TREE STAND

(76) Inventor: Ramon A. Fiveash, 5938 Woodway Place Ct., Houston, TX (US) 77057

( * ) Notice: Subject to any disclaimer, the term of this patent is extended or adjusted under 35 U.S.C. 154(b) by 0 days.

(21) Appl. No.: 10/241,187

(22) Filed: Sep. 11, 2002

(65) Prior Publication Data

US 2004/0045216 A1 Mar. 11, 2004

(51) Int. Cl.[7] ..... A47G 33/12
(52) U.S. Cl. ..... 47/40.5; 248/527
(58) Field of Search ..... 47/40.5; 248/523, 248/524, 527; 411/902, 903, 908, 383, 393

(56) References Cited

U.S. PATENT DOCUMENTS

| | | | | | |
|---|---|---|---|---|---|
| 2,113,688 | A | * | 4/1938 | Grant | 47/41.01 |
| 3,026,075 | A | * | 3/1962 | Phelon et al. | 47/40.5 |
| 3,384,141 | A | * | 5/1968 | Kost | 411/304 |
| 4,048,754 | A | * | 9/1977 | Laux | 47/68 |
| 4,571,881 | A | * | 2/1986 | Lathim | 47/40.5 |
| 4,642,011 | A | * | 2/1987 | Uramoto et al. | 411/258 |
| 5,551,818 | A | * | 9/1996 | Koppel | 411/387.1 |
| 5,580,026 | A | * | 12/1996 | Newcomer | 248/523 |
| 5,690,454 | A | * | 11/1997 | Smith | 411/30 |
| 5,743,508 | A | | 4/1998 | Fiveash | |
| 5,938,168 | A | * | 8/1999 | Adams | 248/523 |
| 6,129,325 | A | * | 10/2000 | Niklas | 248/523 |
| 6,286,804 | B1 | * | 9/2001 | Avinger et al. | 248/523 |
| 6,739,813 | B1 | * | 5/2004 | Gundy et al. | 411/60.2 |
| 2004/0045216 | A1 | * | 3/2004 | Fiveash | 47/40.5 |

FOREIGN PATENT DOCUMENTS

| | | | | |
|---|---|---|---|---|
| DE | 3609357 | A1 * | 10/1987 | A47G/33/12 |
| DE | 4113924 | A1 * | 11/1992 | F16B/13/04 |
| FR | 2629176 | A1 * | 9/1989 | A47G/33/12 |
| GB | 2200966 | A * | 8/1988 | F16B/13/06 |

* cited by examiner

*Primary Examiner*—Jeffrey L. Gellner
(74) *Attorney, Agent, or Firm*—Douglas W. Rommelmann; Andrews Kurth L.L.P.

(57) ABSTRACT

A tree stand having a water reservoir and a plurality of tree support posts therein which are disposed inwardly of the side wall of the reservoir to position the posts close to the tree to minimize the stresses on the bolts which engage the tree for maintaining it in an upright position. The stand may be small enough for use on a table top and molded from a plastic resin, or it may have a reinforcing spike molded into the plastic resin for a stand used for larger trees.

9 Claims, 4 Drawing Sheets

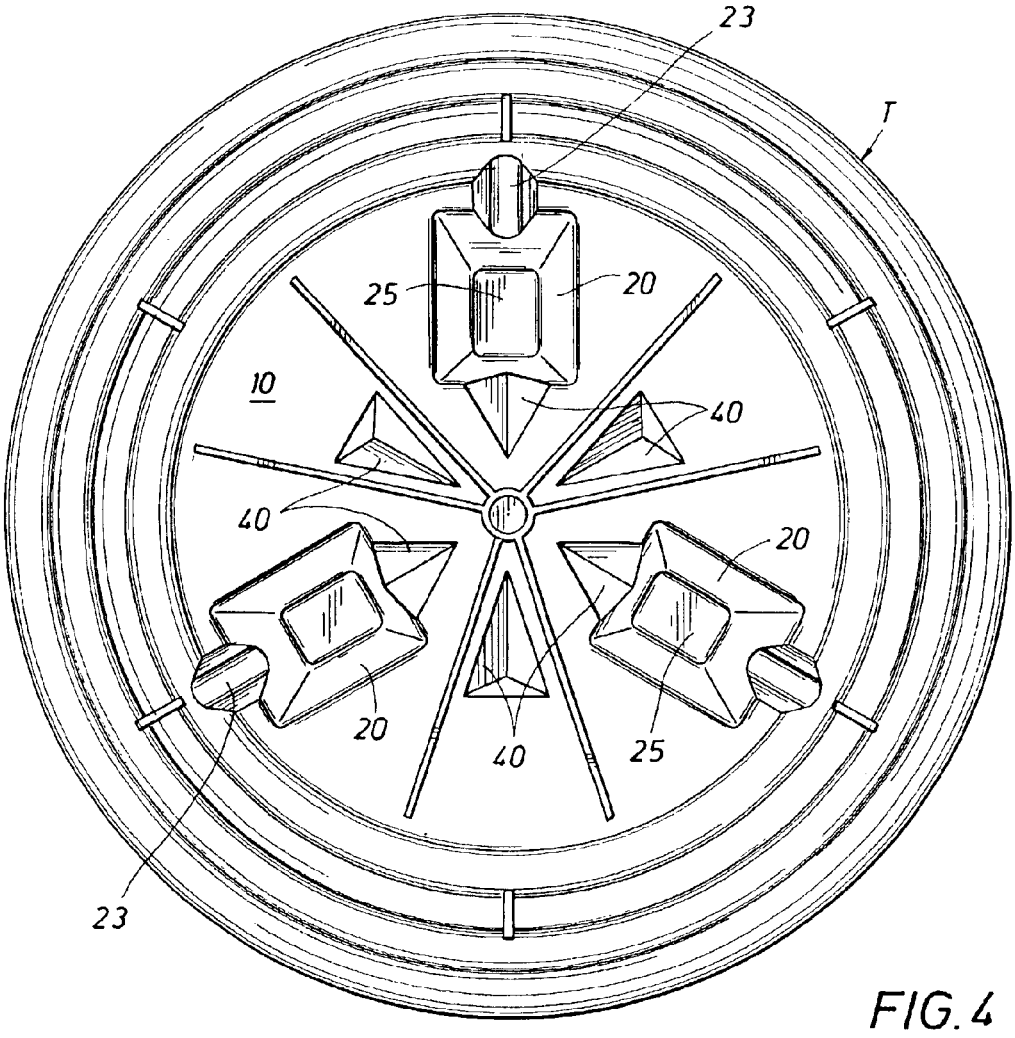
FIG. 4
FIG. 5
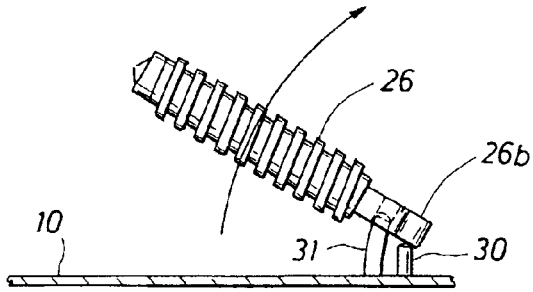

FIG. 6
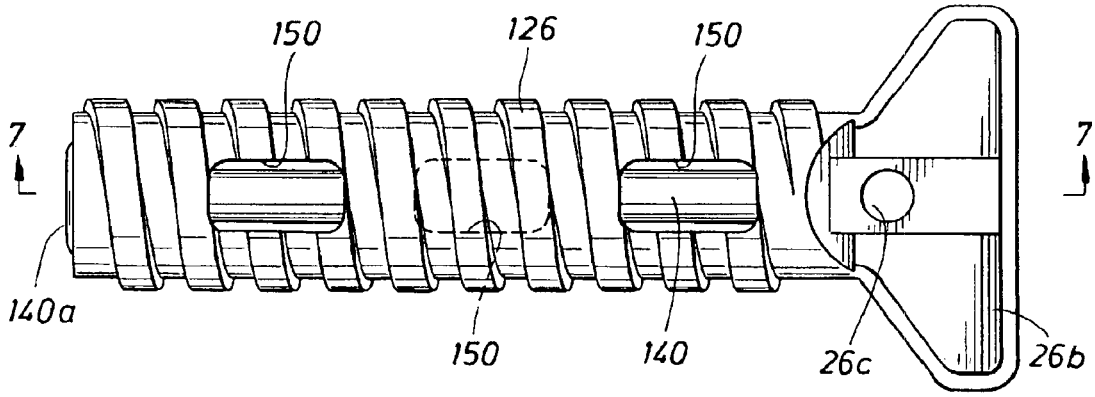
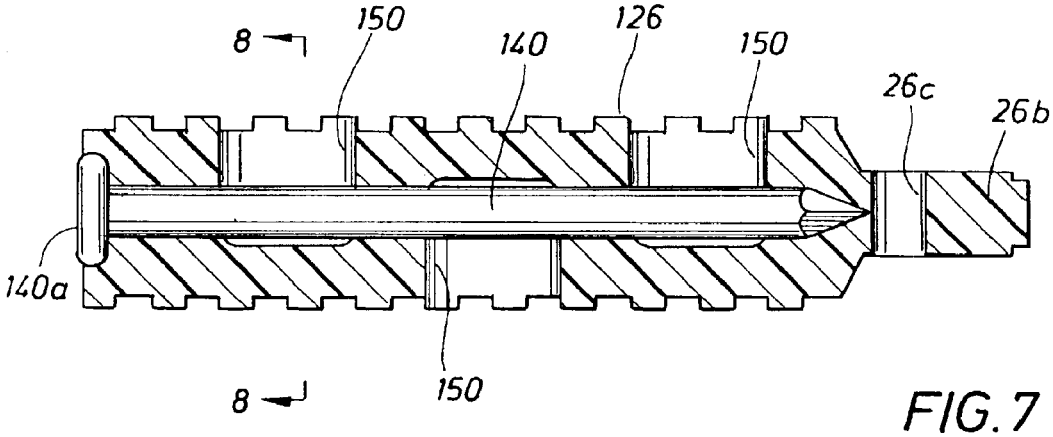
FIG. 7
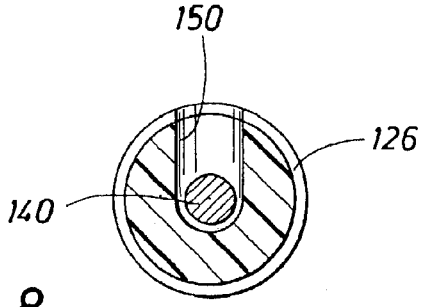
FIG. 8

TREE STAND

CROSS-REFERENCE TO RELATED APPLICATIONS

Not applicable.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates to new and improved stands for real and artificial trees, such as Christmas trees, which stands are of a size that is suitable for location on a tabletop, and for locations that are for larger trees.

2. Description of the Related Art

U.S. Pat. No. 5,743,508 issued Apr. 28, 1998 for a tree stand which included a water basin or reservoir for providing water for maintaining a cut tree, such as a Christmas tree.

The present invention is an improvement on the tree stand disclosed in U.S. Pat. No. 5,743,508 with respect to several features which are discussed in detail herein.

BRIEF SUMMARY OF THE INVENTION

The present invention relates to tree stands which are of a small size for location on a tabletop, but which are also suitable for a tree stand of a larger size. Each stand and a plurality of bolts are molded of a plastic resin such as polypropylene, with the bolts preferably molded separately from the rest of the stand. The bolts are then packaged with the rest of the tree stand for shipping. For the smaller trees usually located on a table top, the bolts may be made entirely of a plastic resin such as polypropylene, but for larger sizes of stands, a steel reinforcing member preferably forms the core of each molded bolt. Preferably, three posts are molded uprightly inwardly of the inner surface of a water basin, with each post receiving one of the bolts for engaging the tree trunk for holding the tree in a vertical position. A plurality of tree stands may be packaged in a nesting position with each other, preferably with three of the bolts packaged together with the stand.

BRIEF DESCRIPTION OF THE SEVERAL VIEWS OF THE DRAWINGS

FIG. 4 is a bottom view of FIG. 1 to illustrate the nesting potential for a plurality of the stands of this invention;

FIG. 5 is a view of a bolt of this invention, showing its releasing position from the stand for permitting the assembly of each bolt in its post or support for engaging the trunk of a tree;

FIG. 6 is a view of a tree engaging bolt which is modified for use with larger trees that are used in locations other than on a table top;

FIG. 7 is a view taken on line 6—6 of FIG. 6, partly in section, showing the modified bolt of FIG. 6 with a steel reinforcing spike molded internally of the plastic forming the bolt; and FIG. 8 is a cross-sectional view taken on line 7—7 of FIG. 7 showing one of several openings in the plastic resin to assist in cooling of the resin during molding.

DETAILED DESCRIPTION OF THE INVENTION

U.S. Pat. No. 5,743,508 was the invention of the present applicant for large trees which were displayed at Christmas time or otherwise inside of buildings or at other locations. In the first embodiment of this invention the Christmas tree stand is desirably located on a table top and therefore is of a smaller size than tree stands usually used. The new and improved tree stand of this invention is also disclosed herein in a modified form for larger tree stands.

The table top Christmas tree stand of this invention is suitable for tree trunks from about one to three inches in diameter. The stand has a reservoir capacity for water of about three fourths of a gallon of water.

Figure 1:
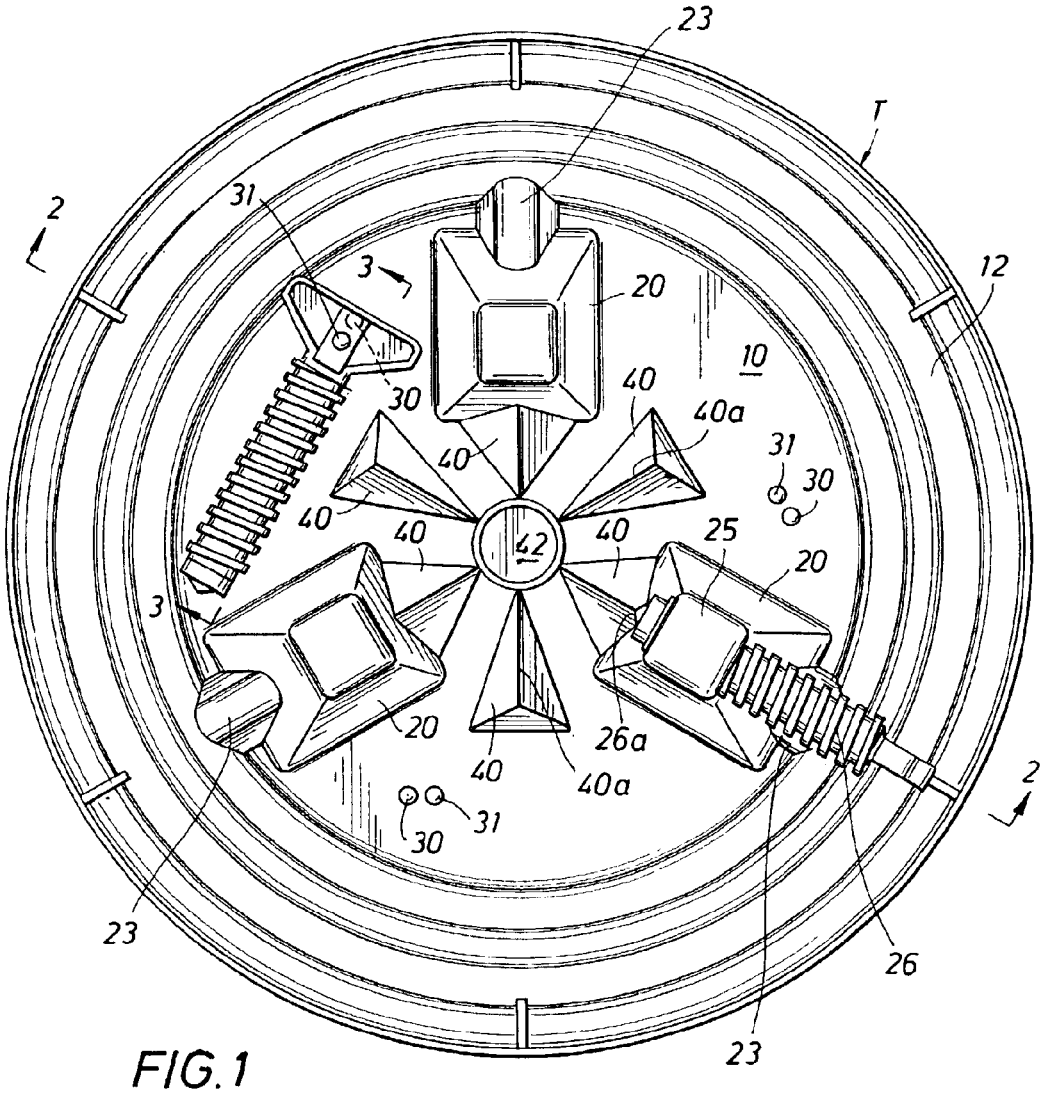
FIG. 1 is a top plan view of the stand of this invention in its table top configuration, showing one of the bolts in use for engaging the trunk of a tree and another of the bolts in the shipping position.
Figure 2:
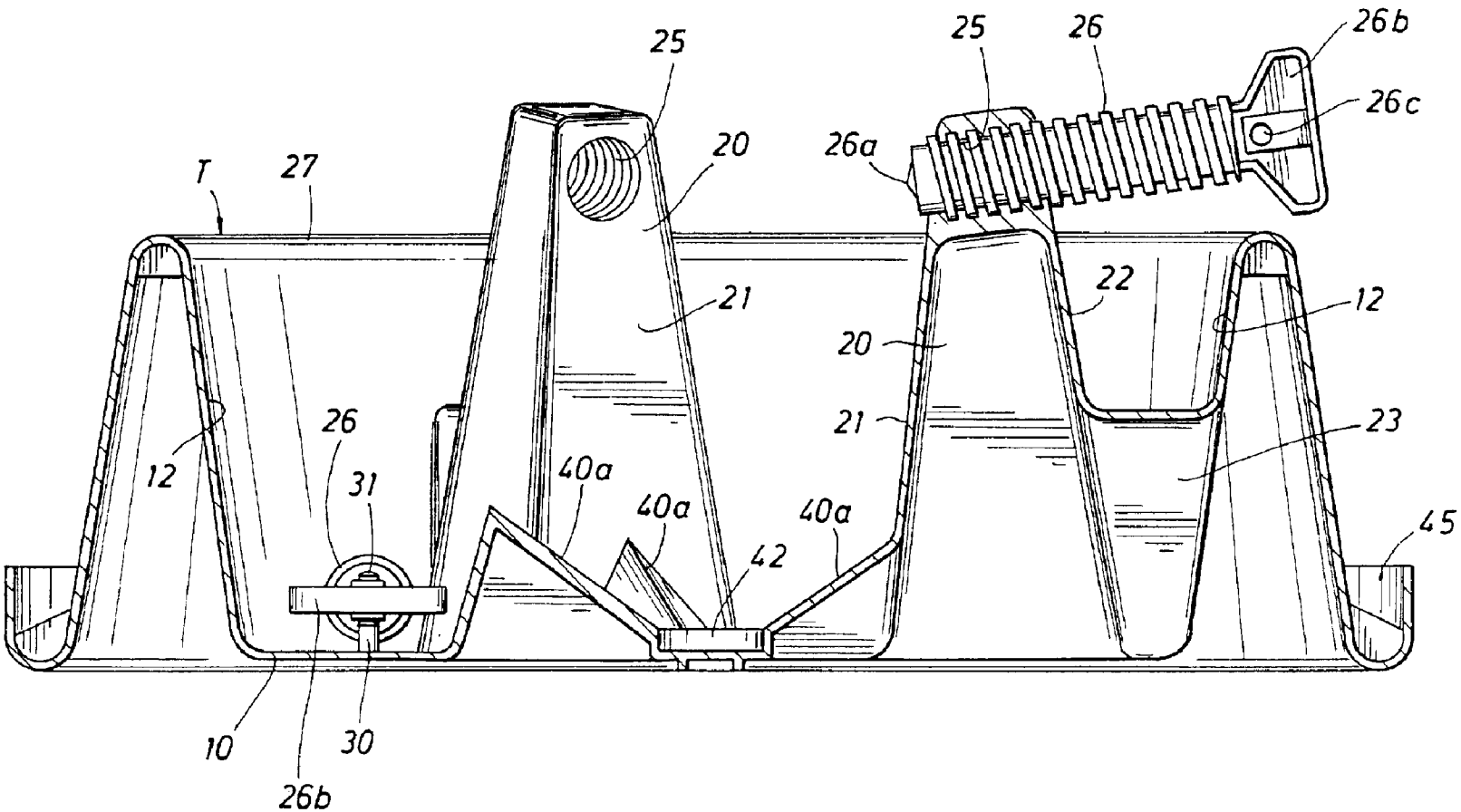
FIG. 2 is an elevation taken on line 2—2 of FIG. 1, showing one bolt in position for engaging the trunk of the tree and another of the bolts on the floor of the stand for shipping.

As shown in FIGS. 1 and 2 in particular, the tree stand T is molded of a plastic resin such as polypropylene to form a water reservoir with a bottom wall 10 and a side wall 12. A plurality of hollow posts or tree support members 20 are molded in the base wall 10. Each post 20 has an inner upright surface 21 and an outer upright surface 22 which are spaced inwardly from the side wall 12 as best seen in FIG. 2. The lower outer portion of each post 20 is connected by a short upright brace 23 which extends between the outer surface 22 and the inner surface 12.

An advantage of the present invention as compared to the construction in U.S. Pat. No. 5,743,508 is that each post 20 is positioned inwardly from the side wall 12 to be close to the tree trunk, as will be explained.

Each of the posts 20 has a threaded internal opening 25 for receiving a bolt 26 which is adapted to be rotated to bring the contact point 26*a* into contact with the trunk of a tree. The upper portion 25*a* of each post 25 is located above the upper surface 27 of the reservoir to facilitate the engagement of the bolts with the tree trunk. By molding the posts 20 inwardly from the side wall 12 of the stand T, the support point for each of the bolts 26 on each of the posts 20 is close to the tree which shortens the length of each bolt from each post 20 to the tree to thereby minimize any undesirable forces on the bolts 26 or the supporting posts 20 when the bolts 26 are tightened into contact with the tree. Therefore, even though the stand T is made entirely of a plastic resin, the bolt tightening forces do not crack or break the bolts or the stand.

Each of the bolts 26 is formed with acme threads or other fast threads that can be rotated rapidly in inward and outward directions for alternately securing and releasing the contact of the bolt end or point 26*a* with the tree trunk. Each bolt 26 has a handle 26*b* to facilitate its rotation. Each bolt is formed of a plastic resin such as polypropylene in the preferred form of the invention.

Figure 3:
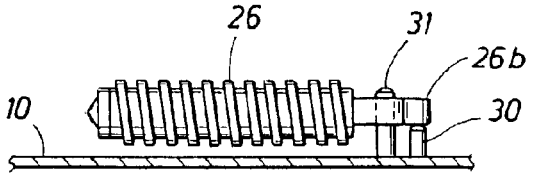
FIG. 3 is a view taken on line 3—3 of FIG. 1, showing one of the bolts mounted in the bottom of the stand for shipping.

During the molding the tree stand T, the bolts 26 are molded at the same time, but separately from the rest of the tree stand T. The open space on the base wall 10 within the inner wall 12 is of a size to receive each of the bolts 26 in a position between the posts 20. Two pins 30 and 31 are molded in the bottom to the base wall 10 as best seen in FIG. 3. Pin 30 is shorter than pin 31. Pin 31 is received in a suitable opening 26*c* (FIG. 6), with the forward portion of the handle 26*b* resting on the pin 30 so that each bolt 26 is securely positioned in the lower portion of the tree stand T for shipping and/or displaying purposes. When it is desired to release the bolts from the that support, each bolt 26 is manually moved or pried as shown in FIG. 5 off of the pin 31, with the forward end of each bolt 26 in contact with the shorter pin 30 serving as the fulcrum point.

For centering the bottom of the tree trunk in the stand, a plurality of centering devices 40, each of which has an inclined surface 40*a* inclined towards the center of the tree stand. A center plate 42 is positioned at the center of the tree stand.

An outer spill guard 45 is preferably provided around the stand in the event that water should spill from the upper surface 27. Also the tree stand is suitable for nesting several of the stands together one on top of the other by reason of having the internal parts of the post and the other parts made with openings in the bottom of the tree stand T as seen in FIG. 4.

The embodiment of this invention shown in FIGS. 6–8 provides a more rigid and stronger bolt 126. A metal spike or rod 140, preferably of steel, forms the core or insert of the bolt 126. Head 140*a* of the spike 140 contacts the tree so that the bending and compressive stresses developed when using the modified form of the invention are taken by the spike 140 rather than just the plastic resin of the bolt 126.

Also, for dissipating the heat to cool the plastic during molding, a plurality of holes 150 are provided in the plastic.

The modified bolts 126 are used with the rest of the structure shown in FIGS. 1 and 2, but they are usually used on larger trees of conventional sizes.

With both forms of the tree stand T, the inner surfaces of the posts or tree support members together with the inner surfaces of the side wall define a water basin, with the advantage of having the support point for each of the bolts at a post located in proximity to the tree trunk and closer to the center of the stand than in previous stands. When tightening the bolts, particularly on rough or irregularly shaped tree trunks, the bolts tend to shift to the side and create lateral and other stresses on the bolts, which is minimized when the bolts are supported closer to the tree. The location of the tree support posts inwardly of the side wall also provides for filling the reservoir at any point around the upper reservoir surface 27 without obstruction by a post or its support, and providing full access for viewing and filling with the amount of water that is confined within the inner wall of each post.

The foregoing disclosure and description of the invention are illustrative and explanatory thereof, and to the extent presently foreseeable, the spirit and scope of the invention are defined by the appended claims.

I claim:

1. A tree stand, comprising:

a water container having a reservoir with a base wall and a side wall;

a plurality of free support members formed with said water container;

said tree support members being spaced from each other and defining a space within said container for receiving the base of a tree trunk;

each said support member having an opening with internal threads in an upper portion thereof;

a plurality of bolts, each said bolt with external threads adapted to fit in threaded engagement with said internal threads in each said support member for rotation to move an inner end of each said bolt into contact with the tree trunk to support the tree in an upright position;

a plurality of pins, each said pin formed in said base wall, wherein each said bolt includes an opening to receive one said pin and form a friction fit, and each said bolt is slidably attached to one said pin for shipping but is removable therefrom for threaded engagement with each said support member.

2. The tree stand of claim 1, wherein:

the tree stand and each said bolt are formed of a plastic resin.

3. The tree stand of claim 2, wherein:

the plastic resin is polypropylene.

4. The tree stand of claim 1, wherein:

each said bolt has a threaded portion formed of a plastic resin and a metal insert extending substantially the length of said threaded portion, said metal insert with a projection at its inner end for engaging the tree.

5. The tree stand of claim 1, wherein:

said threads are fast actuating threads for quickly moving said inner end of each said bolt into engagement with the tree.

6. The tree stand of claim 1, wherein:

each said bolt is formed with a metal reinforcing member which is embedded in a plastic resin, said reinforcing member extending substantially the length of said bolt, said reinforcing member having an inner end substantially free of resin for direct contact with the tree trunk so that the stresses caused by tightening said bolt against the tree are carried by said reinforcing member.

7. The tree stand of claim 1, wherein:

each said bolt has a handle end opposite said inner end, said bolt in said threaded engagement with said support member is at a downward angle such that said inner end is lower than said handle end.

8. The tree stand of claim 1, wherein:

each said bolt attaches to one said pin via a sliding, friction fit.

9. The tree stand of claim 1, wherein:

said bolt opening is formed in a bolt handle.

* * * * *